US009767981B2

(12) United States Patent
Chiu et al.

(10) Patent No.: US 9,767,981 B2
(45) Date of Patent: Sep. 19, 2017

(54) FLUORESCENT DISPLAY TUBE WITH PULSE VOLTAGE DRIVING TO THE CATHODES AT DIFFERENT TIMES

(71) Applicants: Futaba Corporation, Mobara-shi, Chiba (JP); Taiwan Futaba Electronics Corporation, Nan Tze Export Processing Zone, Kaohsiung (TW)

(72) Inventors: Ping-Ning Chiu, Kaohsiung (TW); Yoshikazu Shibuya, Mobara (JP); Yung-Sheng Huang, Kaohsiung (TW); Katsushi Tokura, Mobara (JP)

(73) Assignees: FUTABA CORPORATION, Mobara-Shi, Chiba (JP); TAIWAN FUTABA ELECTRONICS CORPORATION, Nan Tze Export Processing Zone (TW)

( * ) Notice: Subject to any disclaimer, the term of this patent is extended or adjusted under 35 U.S.C. 154(b) by 0 days.

(21) Appl. No.: 15/247,345

(22) Filed: Aug. 25, 2016

(65) Prior Publication Data

US 2017/0062171 A1 Mar. 2, 2017

(30) Foreign Application Priority Data

Aug. 27, 2015 (JP) ..... 2015-168007

(51) Int. Cl.
*H01J 29/98* (2006.01)
*H01J 29/08* (2006.01)
*H01J 31/16* (2006.01)

(52) U.S. Cl.
CPC ..... *H01J 29/98* (2013.01); *H01J 29/085* (2013.01); *H01J 31/16* (2013.01)

(58) Field of Classification Search
CPC ..... H01J 29/98; H01J 29/085; H01J 31/16
(Continued)

(56) References Cited

U.S. PATENT DOCUMENTS 4,401,982 A * 8/1983 Miyazaki ..... H01J 31/15 313/497
4,791,337 A * 12/1988 Murata ..... G09G 3/06 315/168

(Continued)

FOREIGN PATENT DOCUMENTS

CN 102254773 A 11/2011
JP H03065557 10/1985

(Continued)

OTHER PUBLICATIONS

Taiwan Intellectual Property Office, Examination Report and Search Report, Application No. 105127237, dated May 12, 2017.

*Primary Examiner* — Dylan White
(74) *Attorney, Agent, or Firm* — Quarles & Brady LLP

(57) ABSTRACT

This fluorescent display tube includes an anode and a plurality of filament-shaped cathodes both provided in an envelope, a support as one of a pair of support bodies which support the cathodes is electrically divided for each of the cathodes and at the time of driving, and a cathode driving IC gives pulse voltages to the cathodes at different timing. Since the voltages are applied to the arranged cathodes sequentially, current flowing through the cathode driving IC can be small as compared with a case where voltages are simultaneously applied to a plurality of cathodes. Heat generation of the cathode driving IC is suppressed, and costs required for the cathode driving IC are reduced.

6 Claims, 7 Drawing Sheets

(58) Field of Classification Search
USPC ..... 315/326
See application file for complete search history.

(56) References Cited

U.S. PATENT DOCUMENTS

| | | | | |
|---|---|---|---|---|
| 5,811,920 | A * | 9/1998 | Wada | H01J 31/126 313/422 |
| 8,624,480 | B2 | 1/2014 | Maeda | |
| 2010/0117515 | A1* | 5/2010 | Iizawa | H01J 31/15 313/496 |

FOREIGN PATENT DOCUMENTS

| | | | |
|---|---|---|---|
| TW | 571330 | B | 1/2004 |
| TW | 200921741 | A | 5/2009 |
| TW | 201331927 | A | 8/2013 |

* cited by examiner

FLUORESCENT DISPLAY TUBE WITH PULSE VOLTAGE DRIVING TO THE CATHODES AT DIFFERENT TIMES

CROSS-REFERENCE TO RELATED APPLICATIONS

This application claims the priority benefit of Japanese Patent Application 2015-168007 filed Aug. 27, 2015. The contents of this application are hereby incorporated by reference as if set forth in its entirety herein.

BACKGROUND

Technical Field

The present invention relates to a fluorescent display tube in which electrons discharged by a filament-shaped cathodes are made to collide against an anode in an envelope held in a high-vacuum state to display luminously, and more particularly, to a fluorescent display tube having small power consumption of the cathodes.

Related Art

JP 3-65557 A discloses an invention of a fluorescent display device. This fluorescent display device includes an envelope whose interior is held in a high-vacuum state, an anode provided in the envelop, a control electrode provided above the anode within the envelope, and a plurality of filament-shaped cathodes whose both ends are supported by pairs of support bodies. The cathodes are stretched above the control electrode within the envelope. The electrons discharged from the cathodes are controlled by the control electrode by driving the electrodes, and the electrons are made to collide against the anode, thereby making a phosphor layer of the anode emit light. According to the invention of this fluorescent display device, pulse voltage is given to the plurality of connected cathodes, a scanning signal which is in synchronization with the pulse voltage is given to the control electrode, the scanning signal is distributed and supplied to the control electrode which is opposed to the anode corresponding to an end of the cathode during a top period of one cycle of the scanning signal. According to this, influence of end-cold phenomenon at the end of the cathode is avoided without shortening lifetime of the cathode, and a display area can be enlarged.

In the invention disclosed in JP 3-65557 A, as shown in FIG. 6 thereof, both ends of each of the connected plurality of cathodes $5_1, 5_2, \ldots, 5_n$ are connected to a cathode pulse driving circuit 25. Further, in the conventional technique of JP 3-65557 A, as shown in FIGS. 1 and 2, each of both ends of the plurality of filament-shaped cathodes 5 are respectively fixed to a pair of support bodies 4, 4, the pair of support bodies 4, 4 are air-tightly guided outside from the envelope and connected to an outside driving circuit, and driving voltage is given to the support bodies 4, 4.

FIG. 7 shows a configuration of a power source in the above-described conventional fluorescent display device together with a schematically illustrated electrode configuration. Here, the display pattern in the electrode configuration means a display area composed of the anode and the control electrode (grid). The above-described filament-shaped cathode (not shown) is stretched above the display area. A power source configuration which drives the electrodes includes a driver power source VH for giving driver voltage to the anode and the grid, a cathode power source Ef for giving cathode voltage to the cathodes, a logic power source VDD for giving logic voltage to operate a driving IC which drives the power sources of the electrodes by voltage, and a cutoff power source Ek for giving cutoff voltage. The cutoff voltage is potential to bring up potential of the cathodes to avoid a case where heat electron discharged from the filament-shaped cathodes reaches the anode and the grip when the driver power source is OFF and light is emitted.

SUMMARY

According to the conventional fluorescent display device, since currents simultaneously flow through the plurality of filament-shaped cathodes, there is a problem that current consumption is large. Further, if the current is large as compared with low voltage which is determined by specification or a length of the filament-shaped cathode, flexibility of selection of parts of the driving circuit is lowered, and it becomes difficult to configure a power source. Further, in the case of an in-car fluorescent display device, if it lights at night with the same brightness as daytime, it becomes too bright. Therefore, control called dimming lighting to shorten the lighting time at night and to suppress the brightness is performed in some cases. In such a case, since peripheral brightness is lowered, red of a cathode becomes strong and there is a problem that desired display quality cannot be obtained.

The present invention has been achieved to solve the problem of the above-described conventional technique, and it is a main object of the invention to reduce power consumption of cathodes in a fluorescent display tube in which electrons discharged by a filament-shaped cathodes are made to collide against an anode in an envelope held in a high-vacuum state to display luminously, and more particularly, to a fluorescent display tube having small power consumption of a cathode.

A fluorescent display tube according to a first aspect includes: an envelope whose interior is held in a high-vacuum state; an anode to which a phosphor layer is adhered on an anode conductor provided on an inner surface of the envelope; a plurality of filament-shaped cathodes placed above the anode in the envelope by a pair of support bodies which support both ends of each of the cathodes; an anode driving unit for driving the anode; and a cathode driving unit for driving the cathodes, wherein electrons discharged from the cathodes are made to collide against the anode by driving the anode and the cathodes respectively by the anode driving unit and the cathode driving unit, and the phosphor layer is made to emit light, and at least one of the pair of support bodies is electrically divided for each of the cathodes, and the cathode driving unit gives pulse voltages to the cathodes at different timing.

The fluorescent display tube according to a second aspect is the fluorescent display tube according to the first aspect, wherein the cathode driving unit can arbitrarily change a pulse width of the pulse voltage.

The fluorescent display tube according to a third aspect is the fluorescent display tube according to the first aspect, wherein the cathode driving unit gives the pulse voltage only to the cathode corresponding to the anode which is to emit light.

The fluorescent display tube according to a fourth aspect is the fluorescent display tube according to the first aspect, wherein the cathode driving unit and the anode driving unit are respectively formed from separate driving elements.

The fluorescent display tube according to a fifth aspect is the fluorescent display tube according to the first aspect, wherein the cathode driving unit and the anode driving unit commonly use one power source.

The fluorescent display tube according to a sixth aspect is the fluorescent display tube according to the first aspect, wherein the cathode driving unit and the anode driving unit commonly use one driving element.

The fluorescent display tube according to the first aspect has the anode and the plurality of filament-shaped cathodes in the envelope, at least one of the pair of support bodies which support the filament-shaped cathodes is electrically divided for each of the cathodes and when the fluorescent display tube is driven, pulse voltages are given to the cathodes at different timing. That is, voltages are applied to the plurality of filament-shaped cathodes which are arranged side by side while deviating the filament-shaped cathodes one by one. Therefore, as compared with a case where voltages are simultaneously applied to a plurality of filament-shaped cathodes, current flowing through the cathode driving unit can be reduced. Hence, heat generation of the cathode driving unit can be suppressed, and it is possible to reduce costs required for the cathode driving unit.

According to the fluorescent display tube according to the second aspect, it is possible to change time during which voltage is applied to the cathode by arbitrarily changing a pulse width of the pulse voltage. Hence, when it is desired to lower the brightness of the anode when the fluorescent display tube is used at night as compared with a case where it is used at daytime, the pulse width is shortened and time during which voltage is applied to the cathode is shortened, and filament temperature is appropriately maintained. According to this, it is possible to prevent the filament from being more strongly recognized as red. Unlike the above case, if the brightness of the anode is lowered while keeping the cathode voltage as it is like the conventional technique, inconvenience that a filament is more strongly recognized as red in peripheral darkness occurs.

According to the fluorescent display tube according to the third aspect, since it is possible to give pulse voltage only to a necessary cathode in accordance with a display pattern of the anode, power consumption can be reduced.

According to the fluorescent display tube according to the fourth aspect, since the cathode driving unit and the anode driving unit are composed of different driving elements. Hence, a software configuration to be incorporated in each of the elements is more simplified as compared with a case where a single driving element is made to drive two kinds of electrodes.

According to the fluorescent display tube according to the fifth aspect, since the cathode driving unit and the anode driving unit have the single common power source, circuit costs can be reduced as compared with a case where each of the cathode driving unit and the anode driving unit has a dedicated power source.

According to the fluorescent display tube according to the sixth aspect, the one driving element has both functions of the cathode driving unit and the anode driving unit. Hence, circuit costs can be reduced as compared with a case where the cathode driving unit and the anode driving unit are composed of different driving elements.

DETAILED DESCRIPTION

A first embodiment of the present invention will be described with reference to FIGS. 1 to 4.

Figure 1:
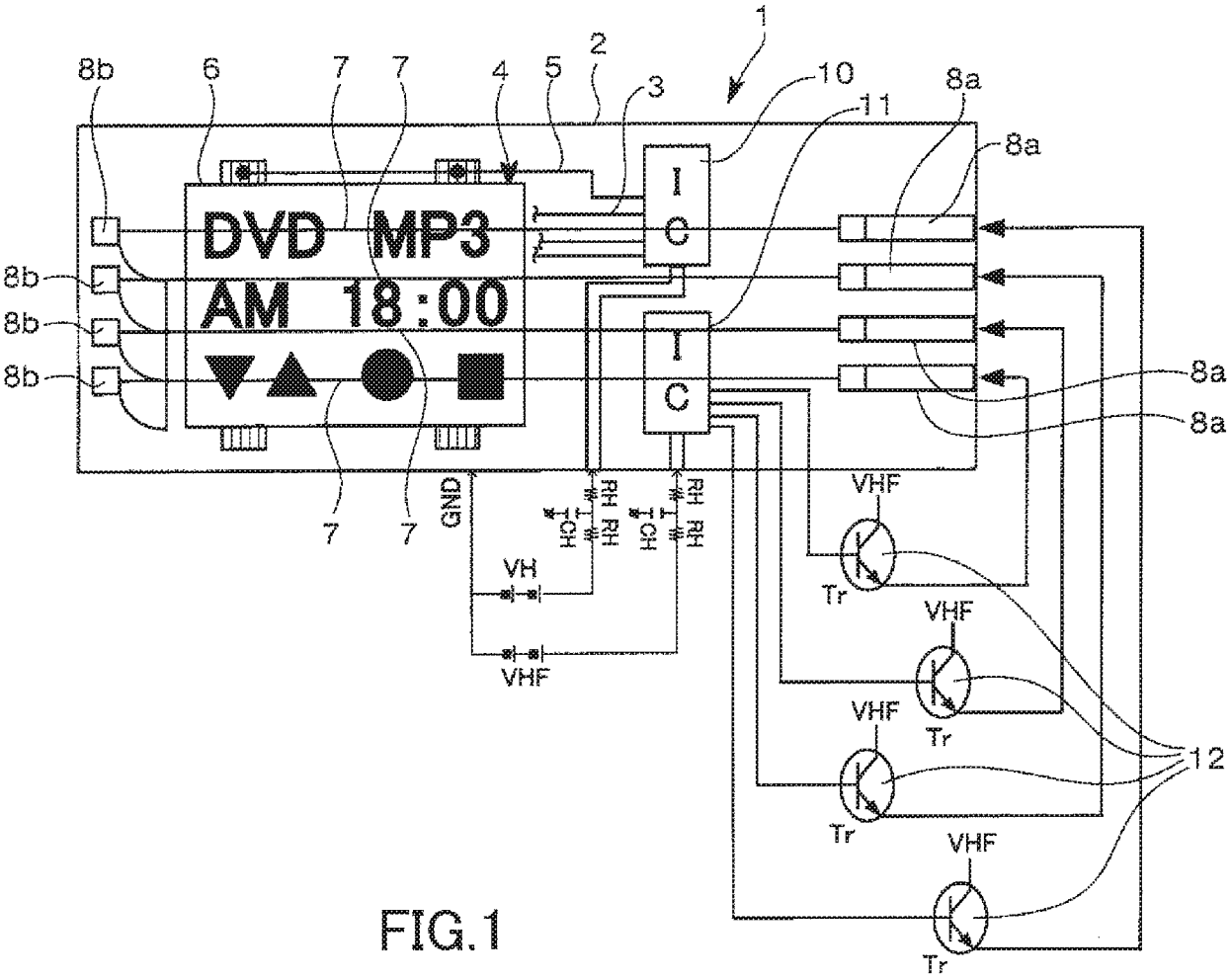
FIG. 1 is a schematic block diagram of a fluorescent display tube according to a first embodiment.

FIG. 1 is a schematic block diagram of a fluorescent display tube 1 according to the first embodiment. This fluorescent display tube 1 includes an envelope 2, and an interior of the envelope 2 is held in a high-vacuum state. The envelope 2 is formed by assembling insulative material, e.g., plate material made of glass for example into a box shape using sealing glass. Although details are not illustrated, an inner surface of a substrate configuring a portion of the envelope 2 is provided with an anode conductor connected to an anode wire 3, a phosphor layer is adhered onto the anode conductor, and an anode 4 of a predetermined light-emitting pattern is configured. Inside the envelope 2, a control electrode 6 (also called "grid") connected to a control electrode wire 5 is placed above an anode 4. Inside the envelope 2, a plurality of filament-shaped cathodes 7 are stretched above the control electrode 6. Both ends of each of the cathodes 7 are connected to pairs of support bodies 8*a* and 8*b*. Ones (right side in FIG. 1) of the pairs of support bodies 8*a* and 8*b* are a plurality of supports 8*a* which are electrically divided for each of the cathodes 7 and which respectively fix one ends of the cathodes 7. The other ones (left side in FIG. 1) are electrically and structurally integral, but are a plurality of anchors 8*b* having arm structures which function as leaf string for giving tensions to the other ends of the cathodes 7.

In this embodiment, although the supports 8*a* are electrically divided for each of the cathodes 7 to individually and sequentially driving the plurality of filament-shaped cathodes 7 by pulse voltages as will be described later, the anchors 8*b* may electrically be divided instead of the supports 8*a*, or both of them may electrically be divided.

An anode driving IC 10 as a driving element which is an anode driving unit for driving the anode 4 is provided in the envelope 2. This anode driving IC 10 also functions as a control electrode driving IC which is a control electrode driving unit for driving the control electrode 6. Therefore, this anode driving IC 10 is connected to an anode grid power source VH, and an input-side terminal of the anode driving IC 10 is located outside the envelope 2. A portion of an output-side terminal of the anode driving IC 10 is connected to anode wire 3, and the other portion of the output-side terminal is connected to the control electrode wire 5.

A cathode driving IC 11 as a driving element which is a cathode driving unit for driving the cathodes 7 is provided in the envelope 2. The input-side terminal of the cathode driving IC 11 is connected to a cathode power source VHF which is located outside the envelope 2. The output-side terminal of the cathode driving IC 11 is electrically divided into the same number of terminals as those of the cathodes 7 so that the plurality of cathodes 7 can individually be driven. The divided output-side terminals are guided to the outside of the envelope 2, and are connected to amplifier circuits 12 composed of transistors Tr located outside the envelope 2.

Figure 2:
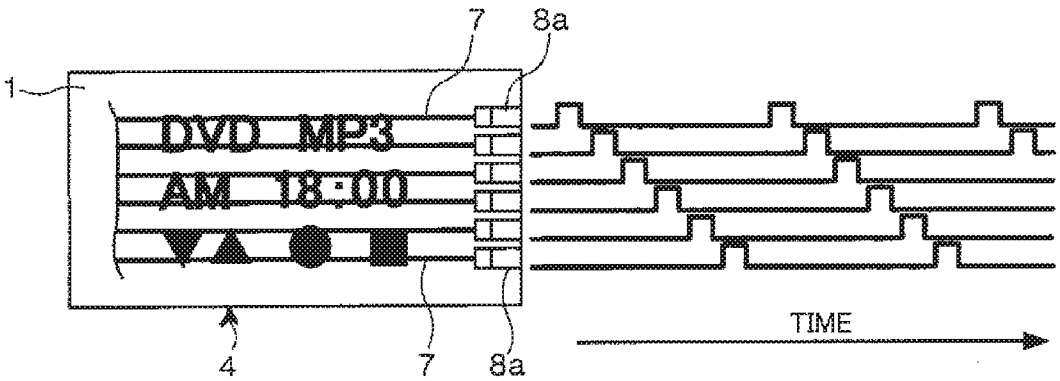
FIG. 2 is a diagram showing the fluorescent display tube when an entire surface lights to light an entire display pattern and showing pulse voltage given to cathodes in the first embodiment.

FIG. 2 is a diagram showing the fluorescent display tube 1 at the time of an entire surface lighting when the entire display pattern of the anode 4 is lighted and showing driving timing of the plurality of cathodes 7 in the first embodiment. When the entire surface of the display pattern lights, the cathode driving IC 11 sequentially gives pulse voltages to the electrically independent plurality of cathodes 7 while deviating timing one by one in the arranged order. The anode driving IC 10 gives predetermined voltages to the anode 4 and the control electrode 6. According to this, electrons are discharged from the cathodes 7, the electrodes are accelerated and controlled by the control electrode 6, and the electrons collide against the anode 4, and the phosphor layer emits light. Light emission of the phosphor layer of the anode 4, i.e., light emission of the display pattern is observed through the translucent envelope 2. In the illustrated example, as display patterns, thick (black finished) literatures, i.e., "DVD" and "MP3" in an upper stage, "AM 18:00" in a middle stage, and other symbols in a lower stage express that they are displayed in a luminescent manner.

According to the fluorescent display tube 1 of this embodiment, the supports 8*a* of the pairs of support bodies 8*a* and 8*b* which support the filament-shaped cathodes 7 are electrically divided for each of the cathodes 7, and when the cathodes 7 are driven, pulse voltages are given to the cathodes 7 at different timing. That is, voltages are applied to the plurality of filament-shaped cathodes 7 which are arranged side by side while deviating the cathodes 7 one by one. Therefore, as compared with a case where the voltages are simultaneously applied to the plurality of filament-shaped cathodes 7, current flowing through the cathode driving unit (cathode driving IC 11 in this embodiment) may be small. For example, when it is necessary to flow current of 30 mA through one cathode 7, the cathodes 7 are driven one by one and two or more cathodes 7 are not driven simultaneously in this embodiment. Therefore, only current of 30 mA which is for one cathode 7 flows as instantaneous current. However, in the conventional fluorescent display tube described in the column of "Related Art", since currents flows through all of the plurality of cathodes collectively, current of 30 mA×the number of cathodes flows. If there are ten cathodes, current of 300 mA flows but in this embodiment, only 30 mA is enough, and a current amount is reduced to 1/10. Generally, to flow more current through the IC, it is necessary to make a wire width in the IC thicker, an outer shape of the IC becomes large and costs thereof increase. According to this embodiment, since the amount of current flowing through the IC is small, heat generation of the cathode driving IC 11 is suppressed, and it is unnecessary to make the wire width in the IC thick. Therefore, costs required for the cathode driving IC 11 can also be reduced.

Figure 3:
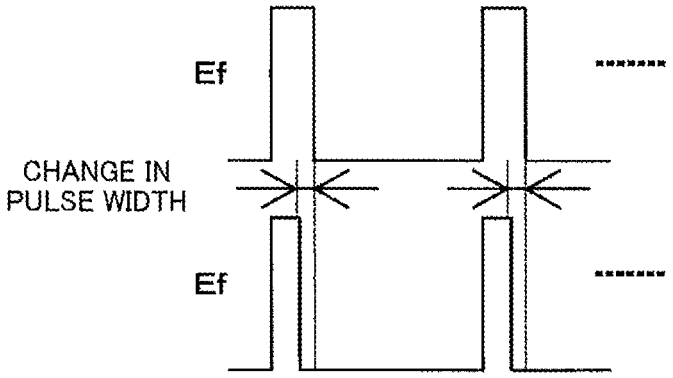
FIG. 3 is a diagram showing, in a vertically contrasting manner, pulse voltage given to the cathodes at the time of normally lighting and at the time of dimming lighting in the first embodiment.

FIG. 3 is a diagram showing pulse voltage Ef given to the cathodes 7, an upper diagram shows normal lighting, and a lower diagram shows dimming lighting. Here, the dimming lighting means adjustment of light emitting brightness of a display pattern in accordance with peripheral brightness, more specifically, the dimming lighting means adjustment carried out when peripheral brightness becomes dark to lower the light emitting brightness of the display pattern which is set in accordance with a state where periphery is bright.

A case where the fluorescent display tube 1 of this embodiment is applied to an in-car display device such as display devices of various kinds of meters and a car navigation system for example will be described. In the case of the in-car display device, since periphery is generally bright during the day, a display pattern emits light at brightness of a predetermined value or higher to secure display visibility. However, at evening to night, since the display which is set during daytime is too bright, dimming lighting for lowering the light emitting brightness of the display pattern is carried out by shortening the lighting time. However, peripheral darkness and temperature of the cathodes 7 become high, there is a problem that red heat of the cathodes 7 becomes outstanding if no countermeasure is taken, and display quality is deteriorated.

Hence, in this embodiment, dimming lighting is carried out by shortening a pulse width as shown in the lower stage in FIG. 3 as compared with a pulse width at the time of normal lighting shown in the upper stage in FIG. 3, thereby shortening time during which voltage is applied to the cathodes. According to this, since the temperature of the cathodes 7 is optimized when periphery is dark, an inconvenient phenomenon that the cathodes 7 glow does not occur, and display quality is maintained at the same level as the daytime normal lighting. This dimming lighting can be carried out only at a specific portion corresponding to a specific cathode 7 in a display area.

Figure 4:
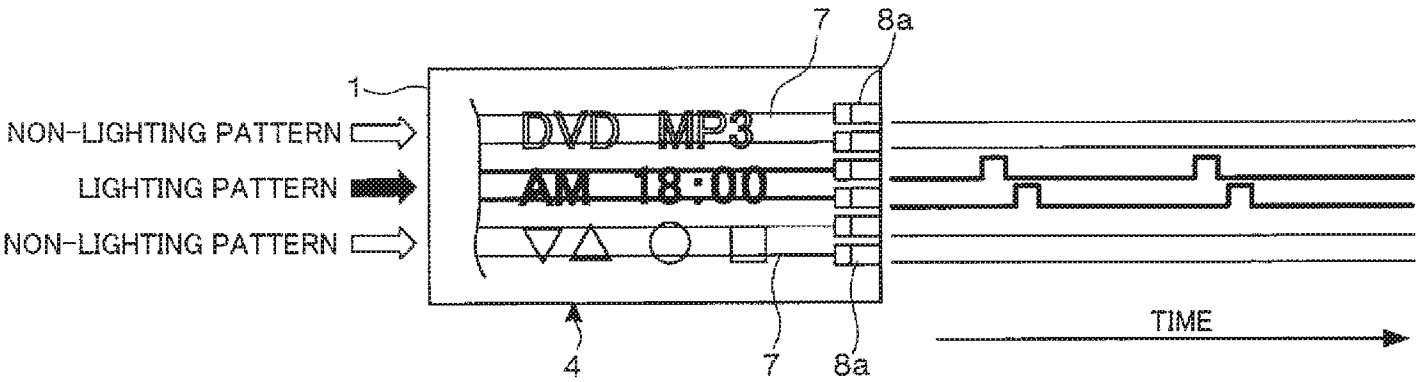
FIG. 4 shows the fluorescent display tube at the time of standby electricity lighting when a portion of the display pattern is lighted, and pulse voltage given to the cathodes in the first embodiment.

FIG. 4 shows the fluorescent display tube 1 at the time of standby electricity lighting when a portion of the display pattern of the anode 4 lights, and pulse voltage given to the cathodes 7 at the time of the standby electricity lighting in this embodiment. Here, in the display pattern, thick (black finished) literatures show that "AM 18:00" in a middle state is displayed in a luminescence manner, and hollow literatures show that "DVD" and "MP3" in an upper stage and other symbols in a lower stage are displayed in a non-luminescence manner.

When such standby electricity lighting is carried out, the cathode driving IC 11 gives pulse voltage only to cathodes 7 (central two cathodes of six cathodes 7 in the illustrated example) which correspond to the display pattern "AM 18:00" of the anode 4 which is to emit light as shown in FIG. 4. According to this driving method, since pulse voltage can be given only to necessary cathodes 7 in accordance with the display pattern of the anode 4, power consumption can be saved or reduced. Electricity is applied to the six cathodes 7 when the entire surface lights shown in FIG. 2, but electricity is applied to two cathodes 7 at the time of standby electricity lighting shown as one example in FIG. 4. Therefore, only 1/3 cathode current is enough at the time of standby electricity lighting as compared when the entire surface lights.

Figure 5:
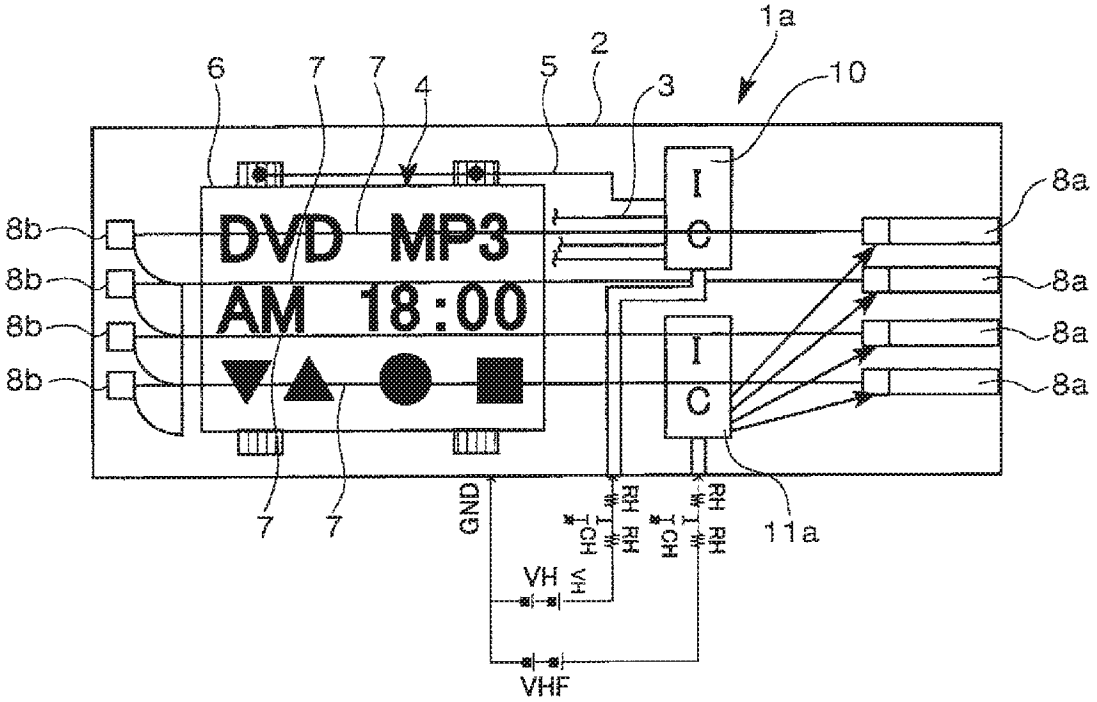
FIG. 5 is a schematic block diagram of a fluorescent display tube according to a second embodiment.

A second embodiment of the present invention will be described with reference to FIG. 5.

A cathode driving IC 11*a* of a fluorescent display tube 1*a* is provided therein with a function of the amplifier circuits 12 in the first embodiment (FIG. 1). Therefore, an amplifier device is not provided outside an envelope 2 of the fluorescent display tube 1*a*. An output-side terminal of the cathode driving IC 11*a* is electrically divided into the same number of terminals as a plurality of cathodes 7 so that the cathodes 7 can individually be driven. The divided output-side terminals are not guided to the outside of the envelope 2, and are directly connected to a plurality of supports 8*a* which are ones of pairs of support bodies 8*a* and 8*b*. Other configurations are the same as those of the first embodiment. According to the second embodiment, the outside amplifier circuits 12 do not exist, and output of the cathode driving IC 11*a* can be output directly to each of the cathodes 7. Therefore, a configuration as an entire device can further be simplified.

Figure 6:
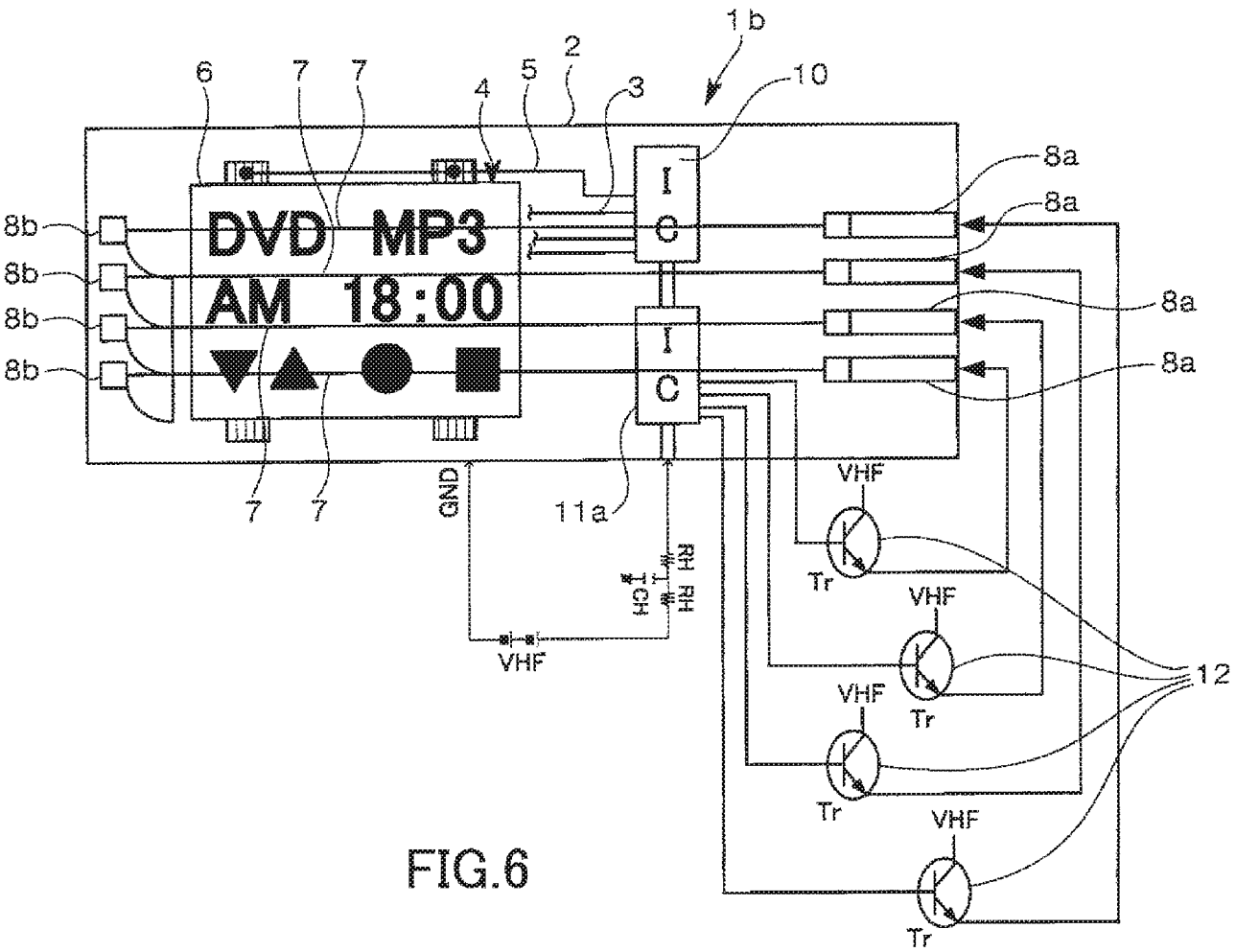
FIG. 6 is a schematic block diagram of a fluorescent display tube according to a third embodiment.
Figure 7:
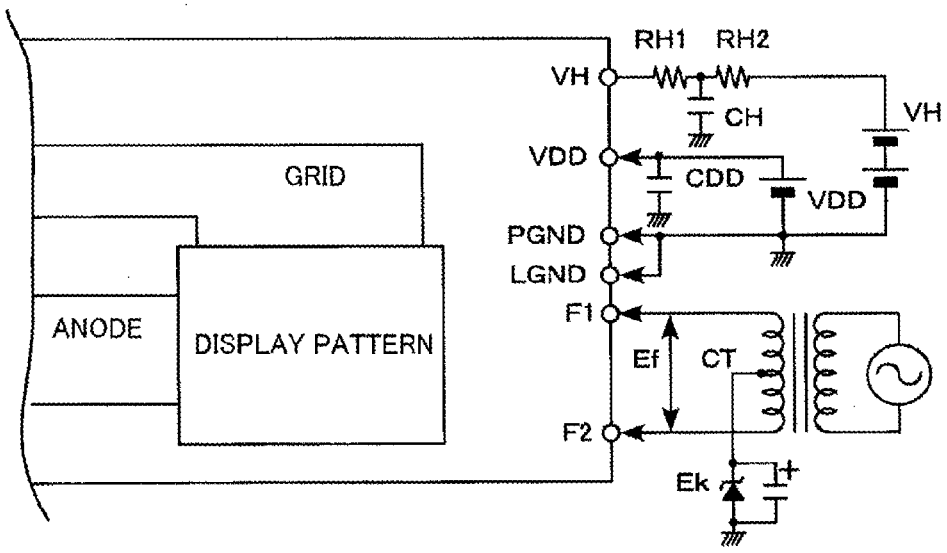
FIG. 7 is a diagram showing a power source configuration in a conventional fluorescent display device.

Although the cathode driving ICs 11, 11*a* and the anode driving IC 10 utilize separate power sources in the above-described embodiments, if the cathode driving IC 11*a* and the anode driving IC 10 commonly use one power source VHF as in a third embodiment shown in FIG. 6, since the number of power sources can be reduced, production costs including circuit costs can be reduced.

The cathode driving ICs 11, 11*a* and the anode driving IC 10 are composed of separate driving elements in the above-described embodiments. Alternatively, if one driving element is commonly used, a function to drive cathodes and a function to drive the anode and the control electrode are incorporated in one element on a software base, it is possible to reduce the circuit costs and production costs as compared with the embodiments.

As described above, according to the fluorescent display tubes 1 and 1*a* of the embodiments, currents does not flow simultaneously through the plurality of filament-shaped cathodes 7, and a dynamic driving method for sequentially applying pulse voltages to the electrically divided cathodes 7 is employed. Therefore, power consumption can be reduced, and it is possible to drive only one or some of cathodes 7 which correspond to an area to be displayed. Hence, a power consumption cutting-off effect at the time of standby electricity lighting is high. Further, when cathode voltage is low and cathode current is large as in the conventional technique, a range selection of parts is narrow and it is difficult to configure a power source. However, since power consumption of the fluorescent display tubes 1, 1*a* of the embodiments is small, it is possible to secure flexibility of selection of parts of the driving circuit, and a configuration of the power source can be facilitated as compared with the conventional technique. When control of dimming lighting is performed, since it is possible to adjust voltage by increasing or reducing a width of the pulse voltage, it is possible to solve the inconvenience that red of the cathode 7 becomes outstanding, and sufficient display quality can be achieved.

REFERENCE SIGNS LIST

1, 1*a*, 1*b* fluorescent display tube
2 envelope
4 anode
7 cathode
8 support body
8*a* support
8*b* anchor
10 anode driving IC as driving element which is anode driving unit
11 cathode driving IC as driving element which is cathode driving unit
12 amplifier circuit
VH anode grid power source
VHF cathode power source
Tr transistor configuring amplifier circuit

What is claimed is:

1. A fluorescent display tube comprising:

an envelope allowing an interior thereof to be held in a high-vacuum state;

an anode in which a phosphor layer is adhered onto an anode conductor provided on an inner surface of the envelope;

a plurality of filament-shaped cathodes placed above the anode in the envelope by a pair of support bodies supporting both ends of each of the cathodes;

an anode driving unit for driving the anode; and a cathode driving unit for driving the cathodes, wherein by driving the anode and the cathodes by the anode driving unit and the cathode driving unit, respectively, electrons discharged from the cathodes are made to collide against the anode so as to allow the phosphor layer to emit light, and wherein at least one of the pair of support bodies is electrically divided for each of the cathodes, and the cathode driving unit gives pulse voltages to each of the cathodes at different timing.

2. The fluorescent display tube according to claim 1, wherein the cathode driving unit can arbitrarily change a pulse width of the pulse voltage.

3. The fluorescent display tube according to claim 1, wherein the cathode driving unit gives the pulse voltage only to the cathode corresponding to the anode which is to emit light.

4. The fluorescent display tube according to claim 1, wherein the cathode driving unit and the anode driving unit are respectively formed from separate driving elements.

5. The fluorescent display tube according to claim 1, wherein the cathode driving unit and the anode driving unit commonly use one power source.

6. The fluorescent display tube according to claim 1, wherein the cathode driving unit and the anode driving unit commonly use one driving element.

* * * * *